US006931843B2

(12) United States Patent
Gilli

(10) Patent No.: US 6,931,843 B2
(45) Date of Patent: Aug. 23, 2005

(54) EXHAUST UNIT FOR ENGINES PARTICULARLY FOR HIGH-PERFORMANCE VEHICLES

(75) Inventor: Alessandro Gilli, Mantova (IT)

(73) Assignee: Supersprint S.r.l., Mantova (IT)

( * ) Notice: Subject to any disclaimer, the term of this patent is extended or adjusted under 35 U.S.C. 154(b) by 0 days.

(21) Appl. No.: 10/487,678

(22) PCT Filed: Sep. 4, 2002

(86) PCT No.: PCT/IB02/03608

§ 371 (c)(1),
(2), (4) Date: Feb. 25, 2004

(87) PCT Pub. No.: WO03/029622

PCT Pub. Date: Apr. 10, 2003

(65) Prior Publication Data

US 2004/0194455 A1 Oct. 7, 2004

(30) Foreign Application Priority Data

Sep. 7, 2001 (IT) ..... TO010164 U

(51) Int. Cl.[7] ..... F01N 7/10
(52) U.S. Cl. ..... 60/323; 60/313
(58) Field of Search ..... 60/323, 324, 313; 285/49, 124.1, 125.1, 223

(56) References Cited

U.S. PATENT DOCUMENTS

| | | | | |
|---|---|---|---|---|
| 3,670,844 A | | 6/1972 | Addison | |
| 5,328,209 A | * | 7/1994 | Cromwell | 285/1 |
| 5,966,933 A | | 10/1999 | Ookawa et al. | |
| 6,086,110 A | * | 7/2000 | Lee et al. | 285/49 |
| 6,164,067 A | * | 12/2000 | Cronje | 60/322 |
| 6,205,778 B1 | | 3/2001 | Akaba | |

FOREIGN PATENT DOCUMENTS

GB 971 405 A 9/1964

* cited by examiner

*Primary Examiner*—Thomas Denion
*Assistant Examiner*—Diem Tran
(74) *Attorney, Agent, or Firm*—Guido Modiano; Albert Josif; Daniel O'Byrne

(57) ABSTRACT

A plurality of pipes adapted to be jointed to the exhaust ports of one line of an engine are joined together into a manifold comprising an equal number of pipe stubs, each receiving one of said pipes. The pipe stubs lead to a box from which extends a conduit that is jointable to terminal parts of the exhaust system, and each of them is flared at its jointed end, against which an annular gasket surrounding the respective pipe is pressed to abut by elastic elements.

7 Claims, 3 Drawing Sheets

EXHAUST UNIT FOR ENGINES PARTICULARLY FOR HIGH-PERFORMANCE VEHICLES

This invention is concerned with an exhaust unit for engines, particularly for high-performance vehicles.

BACKGROUND OF THE INVENTION

Exhaust units in internal-combustion engines as used today comprise a set of pipes which can be jointed to exhaust ports of the engine, which in turn converge into a single end conduit leading to a catalyzer or, in sports cars, directly to a silencer.

Particularly in high-performance engines, such as used in sports and competitions, it is important to design the exhaust system appropriately, with special regard to the dynamics and resistance of the gas flow, since these factors may considerably affect the engine's performance.

With reference to this, it has been found expedient that the exhaust gases from the different cylinders follow paths of substantially equal lengths, and that the pipes fit into the terminal exhaust tube with smooth angles, in order to avoid local resistances to the gas flow. In general, the aim is to favor the confluence of the gases into the terminal conduit, while avoiding that the gases coming from different cylinders may cross and hinder one another.

Exhaust systems designed to optimize the engine's performance according to the above criteria are generally quite bulky and, particularly in view of their monolithic structure, difficult to integrate within the vehicle, which is normally designed for standard exhausts. Consequently, their installation involves disassembling the engine, which is a difficult and time-consuming job.

Moreover, the small dimensional variations which are unavoidable among different frames even if belonging to the same model, and due to tolerances in manufacture and assembly, make it necessary that such exhaust systems have a certain degree of adaptability in assembly.

This requirement has not been satisfactorily met until now, on the one hand, due to the difficulty of inserting flexible components in the pipes because of their high operating temperatures, which do not allow synthetic materials to be used, and, on the other hand, due to the requirement of maintaining a perfect seal in the joints, in order to avoid gas leaks in intermediate areas of the unit.

SUMMARY OF THE INVENTION

It is the main object of the invention to provide an exhaust unit for thermic engines which has the features that are normally required in high-performance vehicles, while providing a better ease of installation, and more particularly dispensing with the need to remove the engine.

Another object of the invention is to provide an exhaust unit having a high adaptability to the manufacturing and assembling tolerances of the frame where it is installed.

A further object of the invention is to provide an exhaust unit having a cost comparable to prior units and which is easy to manufacture, and, moreover, which can be manufactured by procedures known and already in use in the art.

The above and other objects and advantages, which will better appear below, are attained by the invention with an exhaust unit having the features recited in claim 1, while the dependent claims define other advantageous features.

BRIEF DESCRIPTION OF THE DRAWINGS

The invention will now be disclosed in more detail, with reference to the exemplary and non limiting illustration in the attached drawings, wherein.

DESCRIPTION OF THE PREFERRED EMBODIMENTS

Figure 1:
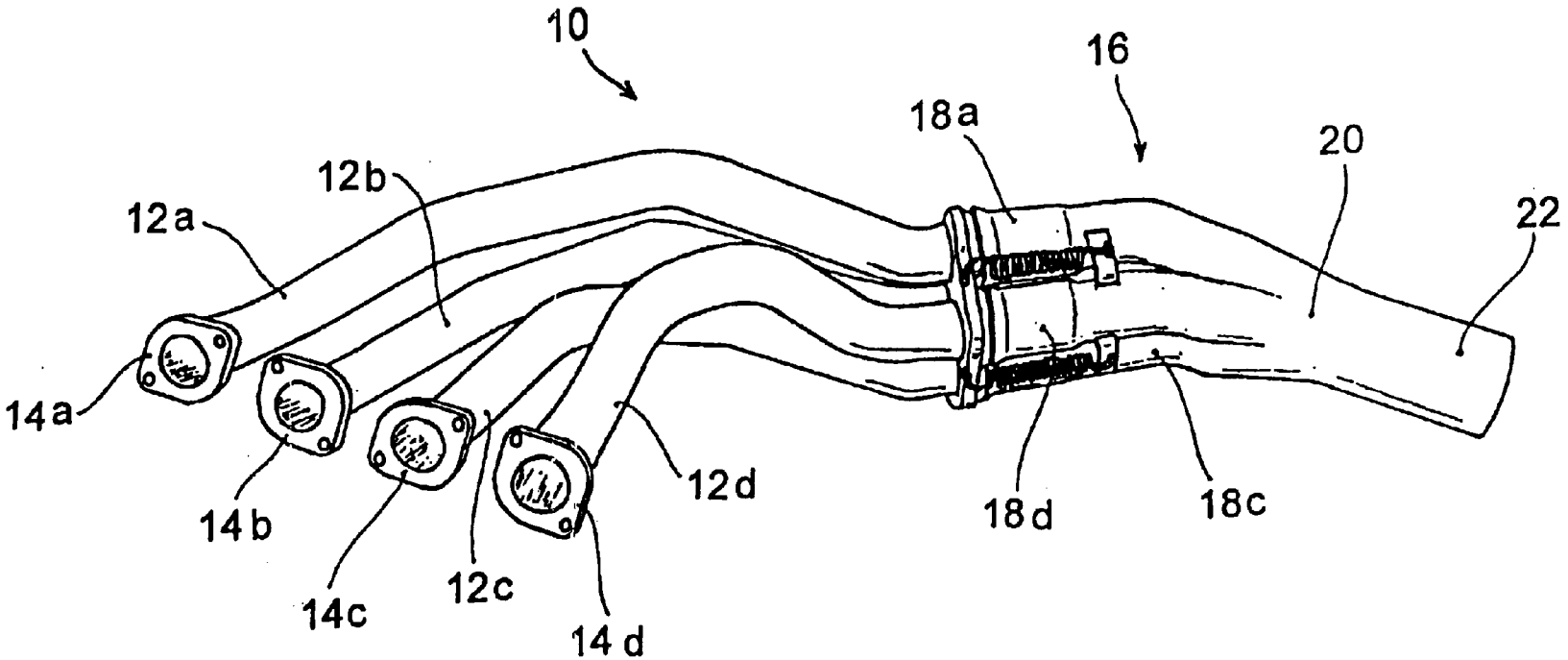
FIG. 1 is a perspective overall view of the exhaust unit according to the invention.
Figure 2:
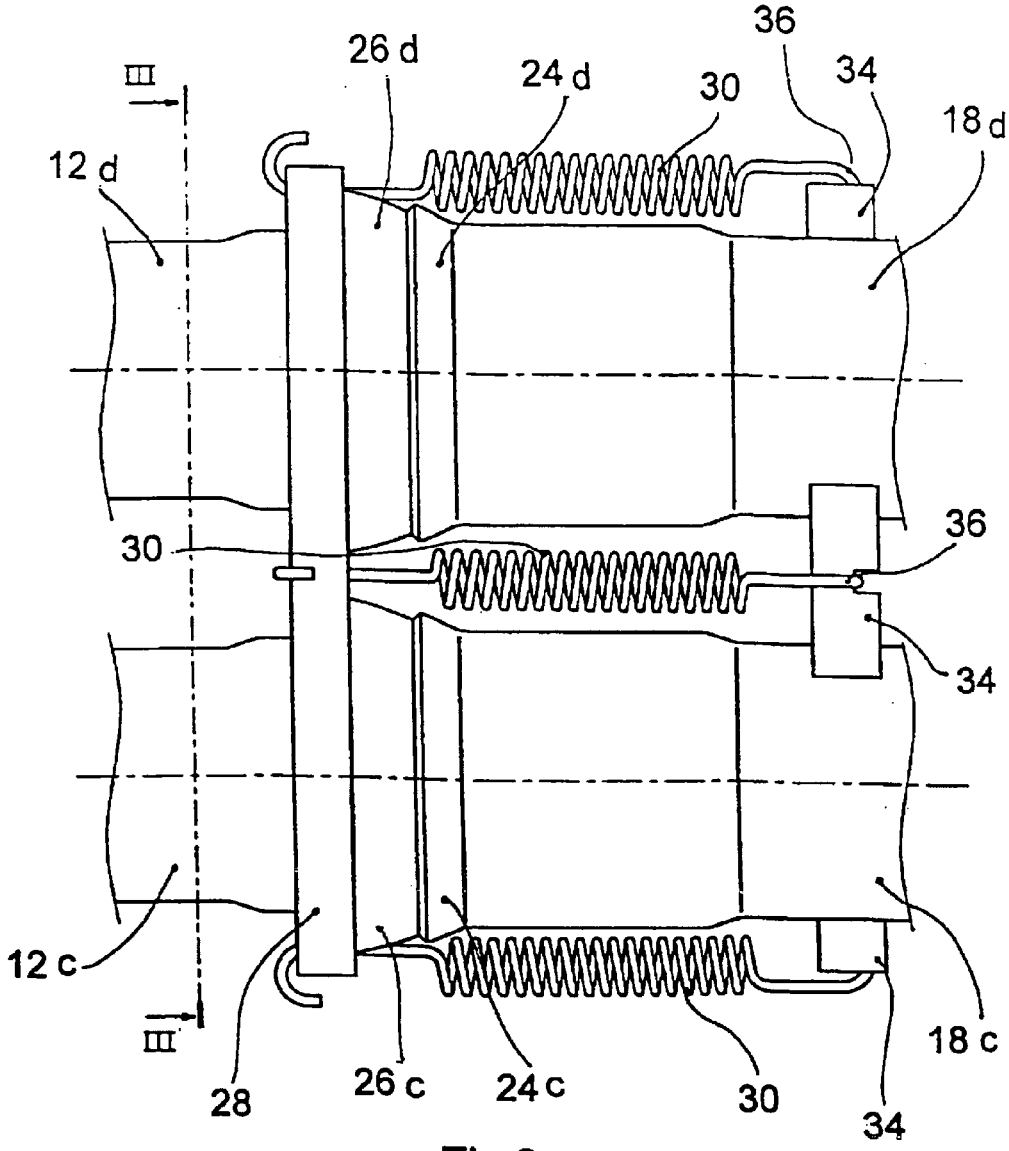
FIG. 2 is an enlarged side view of a detail of the exhaust unit.
Figure 3:
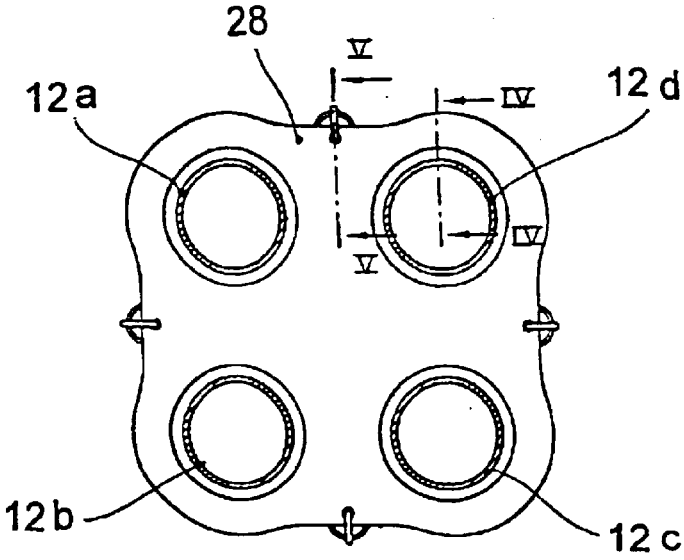
FIG. 3 is an enlarged cross-section view of the exhaust unit of FIG. 1, made along line III—III of FIG. 2.
Figure 4:
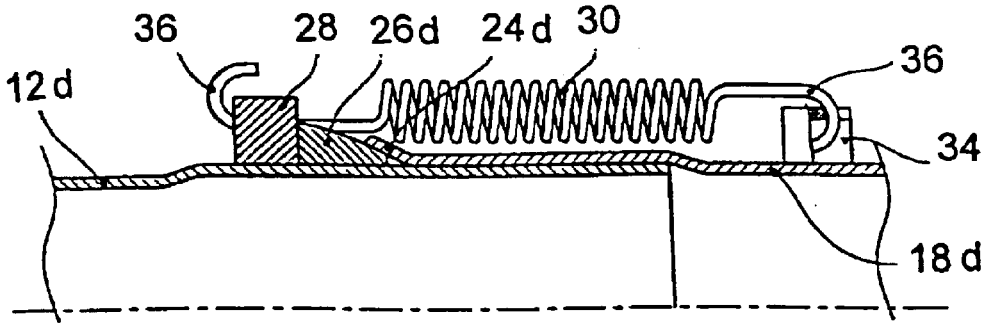
FIG. 4 is an enlarged cross-section view of the exhaust unit of FIG. 1, made along line IV—IV of FIG. 3.
Figure 5:
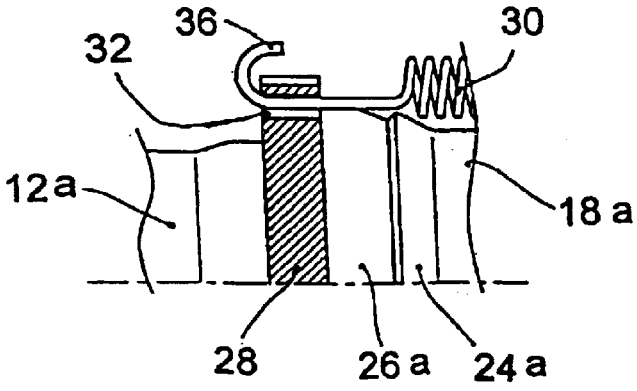
FIG. 5 is an enlarged cross-section view of a detail of the exhaust unit of FIG. 1, made along line V—V of FIG. 3.

With reference to the above listed Figures, these show an exhaust unit 10 jointable to an engine having four cylinder in line comprising four pipes 12*a,b,c,d,* provided with flanges 14*a,b,c,d* for jointing to the exhaust ports of the engine, which four pipes join together into a manifold 16, as described below in more detail.

Pipes 12*a,b,c,d* are shaped so that their lengths are substantially similar, and accordingly they include bent sections which are most visible in pipe 12*d,* which connects to the engine near manifold 16 and consequently requires several bends in order to make the gas path longer.

Manifold 16 comprises four pipe stubs 18*a,b,c,d,* into which the respective pipes 12*a,b,c,d* are inserted. Stubs 18*a,b,c,d* lead to a box 20, from which extends a single conduit 22. Conduit 22 can be jointed to the terminal parts of the exhaust system. Advantageously, both the stub pipes and the conduit extend in substantially parallel directions.

According to the invention, stub pipes 18*a,b,c,d* are flared in 24*a,b,c,d* at their jointing ends. Metal gaskets 26*a,b,c,d,* surrounding pipes 12*a,b,c,d,* respectively, and having substantially frusto-spherical outside surfaces, are maintained in sealed abutment against the flared ends 24*a,b,c,d* by elastic means.

The gaskets might also be made of metal mesh interwoven with synthetic and/or graphite fibers, for enhanced deformability.

The elastic means comprise a plate 28 with four bores, which slidingly receive nines 12*a, b, c, d,* and is biased by four helical extension springs 30 to press the bore edges against the gaskets. These are hooked at their ends so that they will hook at one end into slots 32 made near tire periphery of plate 28 and, at the other end, into four bridges 34, welded across adjacent pipe stubs and having hook-receiving nicks.

The frusto-spherical shape of the gaskets helps to maintain a seal in the joints even if the pipes and the pipe stubs should be slightly misaligned.

Although a four-pipe embodiment has been described, which is suitable for eight-cylinder engines, the invention might obviously be applied to engines having a different number of cylinders, commonly six, ten or twelve: based on the same inventive concept, it is sufficient to make the changes that will be obvious to a person skilled in the art.

Similarly, although the gaskets have a preferably frusto-spherical outside surface, which helps to maintain a seal in the joints even if the pipes and the pipe stubs are slightly misaligned, the gaskets might also have a different shape that should turn out to be suitable, such as frusto-conical.

Also, a larger or smaller number of suitably located helical springs might be used for pressing the plate to abut against the gaskets.

Further, the gaskets might be pressed against the flared pipe ends by means of pairs of opposed rings, one ring acting on the bottom of the gasket, another ring being arranged on the pipe stubs beyond the flared ends, the rings being drawn together by elastic means such as elastic ties or the like.

The plate may be perforated in order to lighten the exhaust unit.

The exhaust unit so designed has a fluid mechanical behavior that will optimize the engine's performance. The manifold having four pipe stubs joining together into a box from which extends a single conduit avoids sharp direction changes in the exhausted fluid, thereby reducing the flow resistance.

Furthermore, by using the same manifold, the length and shape of the pipes can be optimized, based on the several factors affecting the engine's performance and according to the internal hindrances of the vehicle.

These advantages, however, do not affect the ease of installation, because by using the sealing mechanism with frusto-spherical gaskets according to the invention, the pipes can be jointed to the engine and only subsequently they are joined to the terminal parts of the exhaust system through the manifold, thereby considerably simplifying the assembly steps and avoiding the removal of the engine for installing the exhaust unit.

The above exhaust unit has a high degree of adaptability, which enables it to comply with the manufacturing and assembling tolerances of vehicle frames, if one considers that the pipe-manifold connection is longitudinally adjustable, by changing the insertion depth of the pipes into the pipe stubs, and also slight misalignments are absorbed by the frusto-spherical shape of the gaskets.

Still another advantage of the exhaust unit made as disclosed above is that its cost is comparable with known exhaust units, since it is easy to manufacture and does not require equipment or processes that are not already in use in the industry.

In practice, both the materials used and their sizes may be chosen at will, depending on circumstances.

What is claimed is:

1. An exhaust unit for thermic engines, comprising a) a manifold comprising a plurality of flared pipe stubs coalescing into one outlet conduit;

b) a corresponding plurality of exhaust pipes, having respective flanged inlet ends and respective outlet ends that are slidingly received in said flared pipe stubs;

c) a corresponding plurality of annular gaskets fitted on said outlet ends of respective exhaust pipes, each gasket having a tapered profile;

d) elastic means acting between the manifold and the annular gaskets to bias each gasket against the corresponding eared end of the associated pipe stub.

2. The exhaust unit of claim 1, wherein said pipe stubs have substantially equal lengths.

3. The exhaust unit of claim 1, wherein the tapered profile of each of said annular gaskets is substantially frusto-spherical.

4. The exhaust unit of claim 1, wherein said pipe stubs and said outlet conduit extend in substantially parallel directions.

5. The exhaust unit of claim 1, wherein said elastic means comprise a plate, having bores for fitting around said pipes, and biased with the bore edges against said annular gaskets by at least one helical extension spring, the spring being booked to said plate at one end and to the manifold at the opposite end.

6. The exhaust unit of claim 5, wherein said manifold has at least one bridge welded across two adjacent of said pipe stubs, for hooking said at least one helical spring.

7. The exhaust unit of claim 5, wherein said plate is lightened by means of perforations.

* * * * *